US007401745B2

(12) United States Patent
Lacchia

(10) Patent No.: US 7,401,745 B2
(45) Date of Patent: Jul. 22, 2008

(54) POWDER DIFFUSER NOZZLE FOR AN ELECTROSTATIC DUSTING DEVICE WITH ORIENTED JET

(75) Inventor: Adrien Lacchia, Saint Martin le Vinoux (FR)

(73) Assignee: Eisenmann France Sarl (FR)

( * ) Notice: Subject to any disclaimer, the term of this patent is extended or adjusted under 35 U.S.C. 154(b) by 11 days.

(21) Appl. No.: 10/564,218

(22) PCT Filed: Jul. 7, 2004

(86) PCT No.: PCT/FR2004/001770

§ 371 (c)(1),
(2), (4) Date: Jul. 24, 2006

(87) PCT Pub. No.: WO2005/005056

PCT Pub. Date: Jan. 20, 2005

(65) Prior Publication Data

US 2007/0039547 A1 Feb. 22, 2007

(30) Foreign Application Priority Data

Jul. 7, 2003 (FR) ..... 03 08281

(51) Int. Cl.
*B05B 5/00* (2006.01)

(52) U.S. Cl. ..... 239/707; 239/79; 239/85; 239/521; 239/524; 239/525; 239/598; 239/601; 239/706; 118/308; 118/629

(58) Field of Classification Search ..... 239/79, 239/85, 505, 518, 521, 523, 524, 525, 530, 239/567, 568, 706, 707
See application file for complete search history.

(56) References Cited

U.S. PATENT DOCUMENTS 4,790,485 A 12/1988 Yamamoto
4,815,665 A * 3/1989 Haruch ..... 239/523

(Continued)

FOREIGN PATENT DOCUMENTS

WO WO 03/031075 4/2003

OTHER PUBLICATIONS

International Search Report; PCT/FR2004/001770; Nov. 24, 2004.

*Primary Examiner*—Steven J Ganey
(74) *Attorney, Agent, or Firm*—Cantor Colburn LLP

(57) ABSTRACT

The invention relates to a powder diffuser nozzle (2) for an electrostatic dusting device, which is designed to be positioned at the end of an applicator gun. The inventive nozzle (2) comprises: a lateral wall (49) which defines a passage that extends from the powder conduit (8) of the gun (3), and a base (56) which seals said conduit (8) at the end thereof. In addition, a port (57) is provided in the lateral wall (49) close to the base (56) in order to connect the powder conduit (8) with the exterior of the nozzle (2). The axis (A1) of the port (57) forms a determined angle (A) with the axis (A2) of the powder conduit (8). Moreover, at least one deflector (58) is provided on the base of the nozzle (56) or on the lateral wall (49) close to said base in order to divert the jet of powder from the conduit (8) along the axis (A1) of the port (57).

22 Claims, 2 Drawing Sheets

U.S. PATENT DOCUMENTS 4,830,279 A * 5/1989 Crum et al. ..... 239/707
5,353,995 A * 10/1994 Chabert ..... 239/706
5,813,087 A * 9/1998 Huffman ..... 239/521

* cited by examiner

POWDER DIFFUSER NOZZLE FOR AN ELECTROSTATIC DUSTING DEVICE WITH ORIENTED JET

TECHNICAL FIELD OF THE INVENTION

The present invention relates to a powder diffusing nozzle for an electrostatic powder-coating device.

BRIEF DISCUSSION OF THE RELATED ART

The electrostatic powder-coating of mechanical components is performed in the known way by automatic installations, comprising, for example, a spray booth through which the components pass and spray guns spraying the powder more or less at right angles to the axis of movement of the components through the booth.

The geometry of the components being powder-coated may entail orientating the jet of powder from the spray guns by a given angle with respect to the axis of the gun's support arm so as to reach areas that are occluded with respect to the axis of the support arm.

Devices are used for orientating the jet of powder and these rely on the gun or part of the gun being articulated with respect to the gun support arm.

However, these devices have two technical problems:

- the articulation is located some distance away from the end of the gun formed with the nozzle, the part that has to pivot is large in size, and this gives rise to a problem of bulkiness which means that the occluded regions cannot readily be attained;
- the articulation requires an elbow to be formed in the powder duct of the gun. The rubbing of the powder that may be abrasive then leads to accentuated wearing of the duct at the region of the elbow. Replacing the duct in the gun, which is a complicated operation, has then to be performed more frequently.

Furthermore, the guns used are subject to particular safety restrictions.

Each gun comprises an interior duct supplying a jet of powder, a terminal nozzle to shape the jet, and a device for ionizing the powder.

The latter device in particular comprises a high level voltage source and a spike located near the end of the gun and intended to ionize the powder.

The ionization spike may commonly be at an electrical potential of 80 kV with respect to ground. An electric arc can therefore be struck if the end of the gun is brought up close to some other object that is grounded.

Since the striking of electric arcs may damage the installation and cause explosions in powder-saturated environments, regulations limit the capacity of the installation as a whole to 5 millijoules.

This limitation on the capacity has to be complied with by all the devices used.

BRIEF SUMMARY OF THE INVENTION

The present invention provides a solution to the aforementioned technical problems while at the same time complying with the restrictions described hereinabove.

To this end, the present invention relates to a powder diffusing nozzle for an electrostatic powder-coating device and which is intended to be positioned at the end of a spray gun, the nozzle comprising a side wall delimiting a passage extending the powder duct of the gun and an end wall closing the duct at its end, characterized in that at least one orifice is made in the side wall near the end wall connecting the powder duct to the outside of the nozzle, the axis of the orifice making a determined angle with the axis of the powder duct, and in that at least one deflector is formed on the end wall of the nozzle or on the side wall near the end wall of the nozzle to deflect the powder jet from the duct along the axis of the orifice.

This arrangement of the nozzle makes it possible to achieve the desired orientation of the jet while at the same time maintaining a minimum bulk, the entire gun remaining along the same axis. In addition, the component which sustains the most wear due to the orientation of the jet is the deflector rather than the wall of the duct. This arrangement is advantageous because the deflector is readily accessible and easy to replace.

According to one possibility, at least one deflector has, when viewed in section on a plane parallel to the plane containing the axis of the duct and the axis of the orifice, a profile made up of a straight segment that, with the axis of duct, makes an angle more or less equal to the angle between the axis of the orifice and the axis of the duct.

According to another possibility, at least one deflector has, when viewed in section on a plane parallel to the plane containing the axis of the duct and the axis of the orifice, a profile made of two straight segments, the angle of the first segment lying between a zero value and the value of the angle between the axis of the orifice and the axis of the duct, and the angle of the second segment, closest to the orifice, with respect to the axis of the duct being more or less equal to the angle between the axis of the orifice and the axis of the duct.

According to a third possibility, at least one deflector has, when viewed in section on a plane parallel to the plane containing the axis of the duct and the axis of the orifice, a profile forming a curve of increasing gradient, the angle of the tangent to the curve with respect to the axis of the duct near the orifice being more or less equal to the angle between the axis of the orifice and the axis of the duct.

The deflector may adopt various shapes, according to the type of powder used or the desired inclination. For example, the arrangement involving two segments is suited to an angle of the order of 90° between the axis of the orifice and the axis of the duct.

According to one embodiment, at least one deflector has, when viewed in section on a plane perpendicular to the axis of the duct, a concave profile.

According to another embodiment, at least one deflector has, when viewed in section on a plane perpendicular to the axis of the duct, a straight profile.

Altering the profile of a deflector in section on a plane perpendicular to the axis of the duct allows the spontaneous distribution of the powder to be modified. For example, a concave profile makes it possible to compensate for a spontaneous distribution that concentrates itself along the two lateral edges of the orifice. This type of profile makes it possible to keep the jet uniform as it leaves the nozzle.

Advantageously, at least the terminal part of the nozzle comprising the orifice, the end wall and the deflector is mounted such that it can be orientated about the axis of the duct on the end of a spray gun.

The terminal part, mounted such that it can pivot, allows the jet to be orientated along a second axis, still keeping to minimum bulkiness.

Advantageously, at least the terminal part of the nozzle comprising the orifice, the end wall and the deflector is fixed removably to the end of a spray gun.

Fixing the nozzle such that it can be removed makes it possible, on the one hand, to substitute one nozzle for another with a different jet orientation angle, and also allows all or part of the nozzle to be replaced if the deflector of the orifice becomes worn as a result of the rubbing of the powder. This arrangement is advantageous because the component that sustains the most wear due to the orientation of the jet is readily accessible and easy to replace.

According to one possibility, the nozzle comprises an ionization spike for ionizing the jet of powder, this spike being positioned along the axis of the duct and directed in the direction of the jet of powder, the free end of which is situated inside the duct upstream of the end wall in the direction of the jet.

According to another possibility, the nozzle comprises an ionization spike for ionizing the jet of powder, the free end of which is situated near the end wall of the nozzle on the outside thereof.

Advantageously, the ionization spike for ionizing the jet of powder, positioned along the axis of the duct and directed in the direction of the jet of powder, passes through the end wall of the nozzle via a passage formed in the end wall of the nozzle.

According to another possibility, the nozzle comprises an ionization spike for ionizing the jet of powder, the free end of which is situated near the orifice and near the side wall, on the outside of the nozzle.

Advantageously, the ionization spike for ionizing the jet of powder, the base of which is positioned along the axis of the duct and directed in the direction of the jet of powder, passes through the end wall of the nozzle forming an elbow to reemerge via the side wall of the nozzle near the orifice through a passage formed in the end wall and the side wall of the nozzle.

The various arrangements described for the spike make it possible both to guarantee an installation capacity of less than 5 millijoules and also effective ionization of the jet of powder.

Advantageously, the angle between the axis of the orifice and the axis of the powder duct is between 10° and 90°.

According to one embodiment, the angle between the axis of the orifice and the axis of the powder duct is between 45° and 90°.

Advantageously, the orifice is in the form of a slot directed transversely with respect to the axis of the powder duct.

BRIEF DESCRIPTION OF THE DRAWINGS

The invention will be better understood with the aid of the description which follows, with reference to the attached diagrammatic drawing which depicts some embodiments of a nozzle according to the invention.

DETAILED DESCRIPTION OF THE INVENTION

Figure 1:
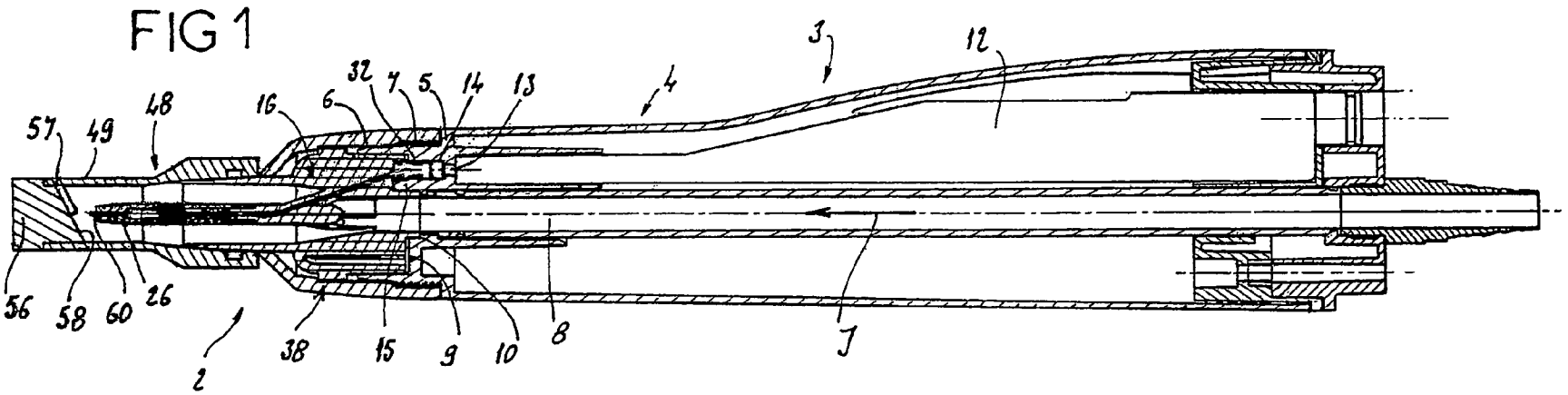
FIG. 1 is a view thereof in longitudinal section in a first embodiment, the nozzle being fixed to a spray gun.

FIG. 1 depicts a powder diffusing nozzle 2 according to the invention fixed on the end of a spray gun 3.

The gun 3 comprises a barrel 4 at the front end of which there is formed a shoulder 5 followed by a cylindrical wall 6 comprising an external screw thread 7 over part of its length.

The gun 3 also comprises a straight powder duct 8 which extends into the nozzle 2. A jet of powder is supplied to the duct in the direction of the arrow J.

The cylindrical wall 6 delimits a bearing wall 9 perpendicular to the axis of the duct 8, a passage being formed for the duct 8 in this bearing wall 9, a cut-out 10 being formed in the portion of the wall of the duct 8 closest to the bearing wall 9.

Furthermore, the gun 3 comprises a device 12 known as a cascade which, via a screw 13, provides a high-voltage source. The cascade device 12 is a voltage multiplier making it possible for example to generate a high voltage of 80 kV from a supply voltage of 300 V.

The screw 13 is housed in an indentation 14 formed in the bearing wall 9. A polarizing device 15 is formed on the bearing wall 9 to position it with respect to the indentation 14 as described hereinbelow.

The nozzle 2 comprises a base 16 comprising a cylindrical portion 17 in which a passage is formed for the powder duct 8.

The rear part 18 of the cylindrical portion 17 has an outside diameter more or less identical to the inside diameter of the cylindrical wall 6 of the barrel 4. This rear part 18 can thus be housed on the front part of the barrel 4 in the space delimited by the cylindrical wall 6 and the bearing wall 9 of the barrel 4.

Figure 3:
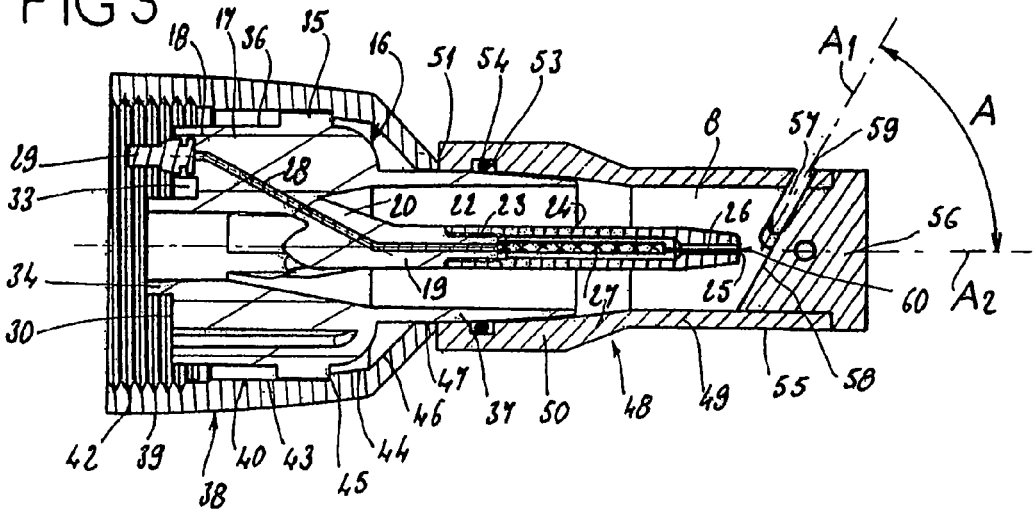
FIG. 3 is a view thereof in longitudinal section in a first embodiment.

As depicted in FIG. 3, the base 16 additionally comprises a spindle-shaped support 19 lying along the axis of the duct 8 and connected to the cylindrical portion 17 by a lug 20. On its front part, the support 19 comprises a shoulder 22 and a tubular portion 23 of a cross section smaller than that of the shoulder 22, for attaching a resistor tube 24. This resistor tube 24 is intended to be affixed by one end to the tubular portion 23 and, at its other end, has an opening 25 of a diameter corresponding to the diameter of an ionization spike 26. This tube 24 and the support 19, which are intended to nest together, constitute a housing for a damping resistor 27 and an ionization spike 26 passing through the opening 25 of the resistor tube 24.

The damping resistor 27 mounted in series with the ionization spike 26 allows the electrical current exchanged in the event of an electric arc being struck to be reduced.

An electrical connection is made between the damping resistor 27 and the high voltage source screw 13 via a conducting insert 28 passing through the support 19, the lug 20 and the cylindrical portion 17 and connected to a terminal 29 situated on the rear wall 30 of the base 16. When the rear part 18 is housed on the front part of the barrel 4 as described above, the terminal 29 lies facing the indentation 14 of the bearing wall 9 containing the screw 13. A spring 32 housed in the indentation 17 then establishes contact between the screw 13 and the terminal 29. A cut-out 33 is formed on the rear wall 30 of the base 16 to complement the polarizing device 15 formed on the bearing wall 9 of the barrel 4, and intended to house the latter when the base 16 is in contact with the bearing wall 9 so as to guarantee that the terminal 30 and the indentation 14 are positioned facing each other.

The base 16 also comprises a short cylindrical wall 34 formed on its rear wall 30, projecting and surrounding the passage of the powder duct 8, this wall 34 being intended to bear against the cut-out 10 formed in the portion of the wall of the duct 8 close to the bearing wall 9 of the barrel 4.

A circular end-stop 35 is formed on the exterior wall 36 of the cylindrical portion 17.

The base 16 additionally comprises a tubular portion 37 comprising a passage for the powder duct 8 and formed at the front end of the cylindrical portion 17, the thickness of this tubular portion 37 decreasing in the direction away from the cylindrical portion 17.

The nozzle 2 also comprises a nozzle nut 38 intended to fix the base 16 onto the barrel 4 of the gun 3. This nut 38 has a tubular shape of varying diameter and comprises, from the rear forwards:

- a section 39 in which the internal wall 40 of the nut has a tapping 42 intended to collaborate with the external screw thread 7 of the end of the barrel 4 of the gun 3,
- a section 43 of constant inside diameter more or less equal to the diameter of the circular end-stop 35 of the base 16,
- a section 44 of inside diameter smaller than the diameter of the circular end-stop 35 of the base 16, the shoulder 45 of which is intended to bear against the circular end-stop 35 so as to hold the base 16 in position between the bearing wall 9 of the barrel 4 and the nut 38,
- a frustoconical section 46 the diameter of which decreases from the preceding section 43, an opening 47 being formed at the end of this frustoconical section 46 the inside diameter of which is equal to the maximum outside diameter of the tubular portion 37 of the base 16, this tubular portion 37 being intended to pass through the opening 47 when the base 16 is fixed.

The nozzle 2 additionally comprises an end-piece 48 comprising a side wall 49.

This side wall 49 of tubular shape comprises:

- a rear section 50 of a diameter that varies between a maximum valve at the rear edge 52 of the end piece 48 and a minimum value forward of the rear edge. The profile of the interior wall of this section 50 corresponds to the profile of the external wall of the tubular portion 37 of the base 16. This section 50 can therefore be tightened onto the tubular portion 37 of the base. A housing 53 for a seal 54 is formed on the internal wall of this section 50. The seal 54 located in this housing 53 enhances the mechanical grip of the end piece 48 on the base 16, and
- a front section 55 of constant diameter, the side wall 49 delimiting a passage for the powder duct 8.

This method of attachment of the end piece 48 to the base 16 allows the end piece 48 to be pivoted about the axis of the duct 8 and thus makes it possible to obtain variable orientations of the jet of powder. Furthermore, this method of attachment allows the end piece 48 to be removed manually and easily in order to replace it when part of it becomes worn.

The end piece 48 also comprises an end wall 56 closing the duct 8 at its front end.

An orifice 57 is formed in the side wall 49 of the end piece 48 near the end wall 56, the orifice 57 connecting the powder duct 8 to the outside of the nozzle 2, the axis A1 of the orifice 57 forming an angle A with the axis A2 of the powder duct 8. In this embodiment, the angle A is equal to 60° and the orifice 57 has the shape of an elongate slot subtending an angle of 90° in the plane of the slot. The plane of the slot intersects the axis A2 of the duct, forming the angle A, the slot therefore being orientated transversely with respect to the axis A2 of the duct.

A deflector 58 is formed on the end wall 56 of the nozzle 2 to deflect the jet of powder from the duct 8 along the axis A1 of the orifice 57. In the embodiment depicted in FIG. 1, the deflector 58 has, in section on a plane parallel to the plane containing the axis A2 of the duct and the axis A1 of the orifice, a straight profile inclined at 60°, corresponding to the angle A of the axis A of the orifice 57 with respect to the axis A2 of the duct 8. The deflector 58 and the orifice 57 are situated close to one another, the front edge 59 of the orifice 57 lying in the extension of the deflector 58.

This end piece 48 comprising an orifice 57 and a deflector 58 both orientated, allows the jet of powder to be orientated without causing problems of bulkiness. Furthermore, the end piece, by virtue of the way in which it is attached, can be replaced and positioned with ease. The duct 8 does not experience excessive wear on its walls because it is straight.

In order to comply with the regulations restricting the capacity of the installation, it is preferable for the spike 26 to be emergent and to constitute a point close to an object brought up nearer to the end of the gun. Indeed, the shape of the spike allows a leakage current to form before an arc is struck, thus making it possible either to avoid the striking of an arc or to significantly reduce the electrical current exchanged as the arc is struck.

The embodiments presented meet the regulations.

Figure 2:
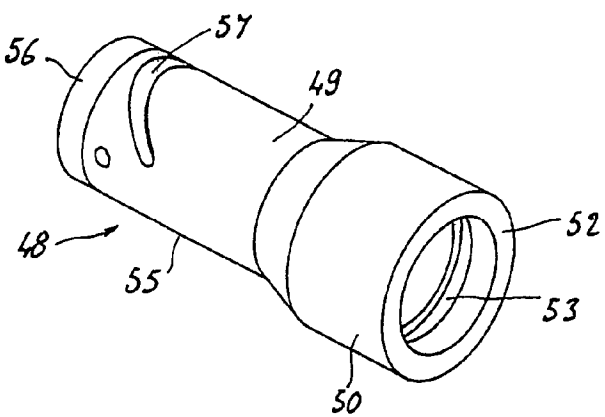
FIG. 2 is a view thereof in perspective in a first embodiment.

In the first embodiment depicted in FIGS. 1, 2 and 3, the free end 60 of the ionization spike 26 is positioned along the axis of the duct 8 and its end lies upstream of the end wall 56 in the direction of the jet through the duct 8.

Figure 4:
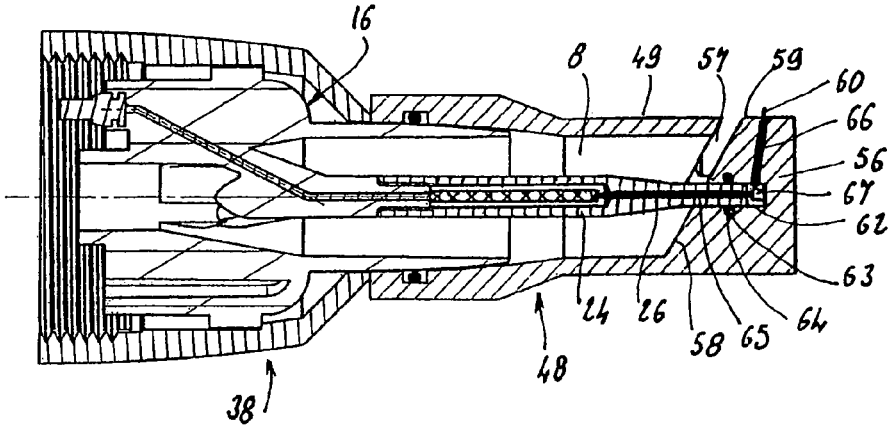
FIG. 4 is a view thereof in longitudinal section in a second embodiment.

According to a second embodiment depicted in FIG. 4, the resistor tube 24 and the ionization spike 26 for ionizing the jet of powder pass through the end wall 56 of the nozzle 2. The ionization spike then forms an elbow to reemerge via the side wall 49 of the end piece 48 of the nozzle 2 near the orifice 57.

A passage 62 is formed in the end wall 56 and the side wall 49 in contact with the end wall 56 of the nozzle 2, to allow the spike to pass. The free end 60 of the spike 26 is located near the front edge 59 of the orifice 57 on the outside of the nozzle 2. A seal 64 is contained in a housing 63 formed in the wall of the passage 62.

To form an elbow, the ionization spike is made up of two straight portions 65 and 66, one of them, 65, lying along the axis of the duct and the other, 66, lying in the direction of the free end, and a rubbing electrical contact 67 housed in the elbow of the duct and maintaining an electrical connection between the two straight portions. This contact 67 makes it easier to mount the nozzle 2 and to orientate the latter, the straight portion 65 of the spike 26 remaining in position, while the straight portion 66 pivots with the end piece 48.

Figure 5:
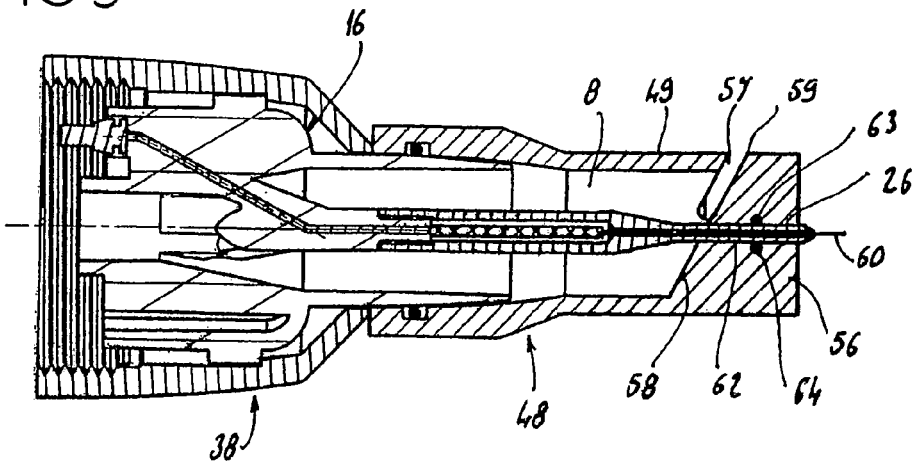
FIG. 5 is a view thereof in longitudinal section in a third embodiment.

According to a third embodiment depicted in FIG. 5, the resistor tube 24 and the ionization spike 26 for ionizing the jet of powder pass through the end wall 56 of the nozzle 2 via a passage 62 formed axially in the end wall 56 of the nozzle 2, the free end 60 of the spike 26 being situated near the end wall 56 of the nozzle 2 on the outside thereof. A seal 64 is contained in a housing 63 formed in the wall of the passage 62.

The profile of the deflector 58 in section on a plane perpendicular to the axis A2 of the duct 8 may exhibit various shapes, according to the desired effect. By way of example, in the case of an orifice 57 in the form of an elongate slot, the deflector 58 may exhibit a concave profile, so as to compensate for a spontaneous distribution of powder concentrated at the two side edges of the orifice 57. This type of profile makes it possible to keep the jet leaving the nozzle 2 uniform.

The orifice 57 in this case has a slightly curved shape suited to the concave shape of the deflector 58.

In one embodiment that has not been depicted, a deflector has, in section on a plane parallel to the plane containing the axis of the duct and the axis of the orifice, a profile made up of two straight segments, the angle of the second segment with respect to the axis of the duct 8 being equal to the angle between the axis of the orifice and the axis of the duct, the angle of the first segment being equal for example to half the value of the angle between the axis of the orifice and the axis of the duct.

This arrangement involving two segments is particularly advantageous when the angle of the axis of the orifice with respect to the axis of the duct is of the order of 90°.

In another embodiment that has not been depicted, a deflector has, in section on a plane parallel to the plane containing the axis of the duct and the axis of the orifice, a profile constituting a curve with increasing gradient, the angle of the tangent to the curve near the orifice being equal to the angle between the axis of the orifice and the axis of the duct.

According to the various variants, the deflector has a shape and surface area allowing the jet of powder to be deflected in its entirety or allowing at least a substantial proportion, greater than 50%, of the jet to be deflected.

In another embodiment that has not been depicted, the end piece of the nozzle and the base are formed as a single orientable component. This component has no polarizing feature and can therefore be orientated in terms of rotation about the axis of the duct when the nut is slackened off. The electrical connection between the ionization spike and the high-voltage source may be achieved by a contact provided axially or by a contact of annular shape centered on the axis of the duct. When the nut is tightened, the nozzle is held in position, maintaining the given orientation.

The angle A between the axis A1 of the orifice 57 and the axis A2 of the duct 8 may adopt varying values, ranging in particular between 10 and 90°.

The invention is not restricted to the embodiments described but, on the contrary, encompasses all variants thereof. Thus, in particular, the deflectors 58 may have different profiles.

The invention claimed is:

1. A powder diffusing nozzle for an electrostatic powder-coating device and which is intended to be positioned at the end of a spray gun, the nozzle comprising:

a side wall delimiting a passage extending a powder duct of the gun and an end wall closing the duct at its end, wherein at least one orifice is made in the side wall near the end wall connecting the powder duct to the outside of the nozzle;

an axis (A1) of the orifice making a determined angle (A) with an axis (A2) of the powder duct, and wherein at least one deflector is formed on the end wall of the nozzle or on the side wall near the end wall of the nozzle to deflect a powder jet from the duct along the axis (A1) of the orifice; and an ionization spike for ionizing the jet of powder, a free end of which is situated near the end wall of the nozzle on the outside thereof.

2. The diffusing nozzle as claimed in claim 1, wherein the angle (A) between the axis (A1) of the orifice and the axis (A2) of the powder duct is between 10° and 90°.

3. The diffusing nozzle as claimed in claim 2, wherein the angle (A) between the axis (A1) of the orifice and the axis (A2) of the powder duct is between 45° and 90°.

4. The diffusing nozzle as claimed in claim 1, wherein the orifice is in the form of a slot directed transversely with respect to the axis (A2) of the powder duct.

5. The diffusing nozzle as claimed in claim 1, wherein at least one deflector has, when viewed in section on a plane parallel to a plane containing the axis (A2) of the duct and the axis (A1) of the orifice, a profile made up of a straight segment that, with the axis of duct, makes an angle more or less equal to the angle (A) between the axis (A1) of the orifice and the axis (A2) of the duct.

6. The diffusing nozzle as claimed in claim 1, wherein at least one deflector has, when viewed in section on a plane parallel to a plane containing the axis (A2) of the duct and the axis (A1) of the orifice, a profile made of two straight segments, an angle of the first segment lying between a zero value and the value of the angle (A) between the axis (A1) of the orifice and the axis (A2) of the duct, and an angle of the second segment, closest to the orifice, with respect to the axis (A2) of the duct being more or less equal to the angle (A) between the axis (A1) of the orifice and the axis (A2) of the duct.

7. The diffusing nozzle as claimed in claim 1, wherein at least one deflector has, when viewed in section on a plane parallel to a plane containing the axis (A2) of the duct and the axis (A1) of the orifice, a profile forming a curve of increasing gradient, an angle of a tangent to the curve with respect to the axis (A2) of the duct near the orifice being more or less equal to the angle (A) between the axis (A1) of the orifice and the axis (A1) of the duct.

8. The diffusing nozzle as claimed in claim 1, wherein at least one deflector has, when viewed in section on a plane perpendicular to the axis of the duct, a concave profile.

9. The diffusing nozzle as claimed in claim 1, wherein at least one deflector has, when viewed in section on a plane perpendicular to the axis of the duct, a straight profile.

10. The diffusing nozzle as claimed in claim 1, wherein at least a terminal part of the nozzle comprising the orifice, the end wall and the deflector is mounted such that it can be orientated about the axis (A2) of the duct on the end of a spray gun.

11. The diffusing nozzle as claimed in claim 1, wherein at least a terminal part of the nozzle comprising the orifice, the end wall and the deflector is fixed removably to the end of a spray gun.

12. A powder diffusing nozzle for an electrostatic powder-coating device and which is intended to be positioned at the end of a spray gun, the nozzle comprising;

a side wadelimiting a passage extending a powder duct of the gun and an end wall closing the duct at its end, wherein at least one orifice is made in the side wall near the end wall connecting the powder duct to the outside of the nozzle;

an axis (A1) of the orifice making a determined angle (A) with an axis (A2) of the powder duct, and wherein at least one deflector is formed on the end wall of the nozzle or on the side wall near the end wall of the nozzle to deflect a powder jet from the duct along the axis (A1) of the orifice; and an ionization spike for ionizing the jet of powder, a free end of which is situated near the orifice and near the side wall, on the outside of the nozzle.

13. The diffusing nozzle as claimed in claim 12, wherein at least one deflector has, when viewed in section on a plane parallel to a plane containing the axis (A2) of the duct and the axis (A1) of the orifice, a profile made up of a straight segment that, with the axis of duct, makes an angle more or less equal to the angle (A) between the axis (A1) of the orifice and the axis (A2) of the duct.

14. The diffusing nozzle as claimed in claim 12, wherein at least one deflector has, when viewed in section on a plane parallel to a plane containing the axis (A2) of the duct and the axis (A1) of the orifice, a profile made of two straight segments, an angle of the first segment lying between a zero value and the value of the angle (A) between the axis (A1) of the orifice and the axis (A2) of the duct, and an angle of the second segment, closest to the orifice, with respect to the axis (A2) of the duct being more or less equal to the angle (A) between the axis (A1) of the orifice and the axis (A2) of the duct.

15. The diffusing nozzle as claimed in claim 12, wherein at least one deflector has, when viewed in section on a plane parallel to a plane containing the axis (A2) of the duct and the axis (A1) of the orifice, a profile forming a curve of increasing gradient, an angle of a tangent to the curve with respect to the axis (A2) of the duct near the orifice being more or less equal to the angle (A) between the axis (A1) of the orifice and the axis (A1) of the duct.

16. The diffusing nozzle as claimed in claim 12, wherein at least one deflector has, when viewed in section on a plane perpendicular to the axis of the duct, a concave profile.

17. The diffusing nozzle as claimed in claim 12, wherein at least one deflector has, when viewed in section on a plane perpendicular to the axis of the duct, a straight profile.

18. The diffusing nozzle as claimed in claim 12, wherein at least a terminal part of the nozzle comprising the orifice, the end wall and the deflector is mounted such that it can be orientated about the axis (A2) of the duct on the end of a spray gun.

19. The diffusing nozzle as claimed in claim 12, wherein at least a terminal part of the nozzle comprising the orifice, the end wall and the deflector is fixed removably to the end of a spray gun.

20. The diffusing nozzle as claimed in claim 12, wherein the angle (A) between the axis (A1) of the orifice and the axis (A2) of the powder duct is between 10° and 90°.

21. The diffusing nozzle as claimed in claim 20, wherein the angle (A) between the axis (A1) of the orifice and the axis (A2) of the powder duct is between 45° and 90°.

22. The diffusing nozzle as claimed in claim 12, wherein the orifice is in the form of a slot directed transversely with respect to the axis (A2) of the powder duct.

* * * * *